US005155753A

United States Patent [19]

Kuetterer

[11] Patent Number: 5,155,753

[45] Date of Patent: Oct. 13, 1992

[54] X-RAY DIAGNOSTICS INSTALLATION WHICH PERMITS ADJUSTMENT OF THE POSITION OR SIZE OF THE DOMINANT REGION OF THE IMAGE

[75] Inventor: Gerhard Kuetterer, Erlangen, Fed. Rep. of Germany

[73] Assignee: Siemens Aktiengesellschaft, Munich, Fed. Rep. of Germany

[21] Appl. No.: 647,700

[22] Filed: Jan. 29, 1991

Related U.S. Application Data

[63] Continuation of Ser. No. 473,829, Feb. 2, 1990, abandoned.

[30] Foreign Application Priority Data

Feb. 20, 1989 [EP] European Pat. Off. ..... 89102904.3

[51] Int. Cl.[5] ..... H05G 1/64

[52] U.S. Cl. ..... 378/99; 358/111

[58] Field of Search ..... 378/99; 358/111

[56] References Cited

U.S. PATENT DOCUMENTS 4,472,826 9/1984 van de Ven ..... 378/99

4,809,309 2/1989 Beekmans ..... 378/99

FOREIGN PATENT DOCUMENTS 0087843 9/1983 European Pat. Off. .

0217456 4/1987 European Pat. Off. .

OTHER PUBLICATIONS

Patent Abstracts of Japan vol. 6, No. 168 (p. 139) (1046) Sep. 2, 1982, for Japanese Kokai 57-084446.

*Primary Examiner*—Craig E. Church

*Attorney, Agent, or Firm*—Hill, Van Santen, Steadman & Simpson

[57] ABSTRACT

An x-ray diagnostics installation for producing x-ray images has an x-ray image intensifier with an output screen on which a light image corresponding to x-rays attenuated by an examination subject is present, the light image having a dominant region of primary medical interest. A detector is provided for measuring the mean image brightness of the dominant region, the detector having an optical imaging scale. An adjustment element is provided for varying the optical imaging scale of the detector so that at least one of the position and size of the dominant region is adjustable with respect to the light image.

6 Claims, 1 Drawing Sheet

FIG 1

X-RAY DIAGNOSTICS INSTALLATION WHICH PERMITS ADJUSTMENT OF THE POSITION OR SIZE OF THE DOMINANT REGION OF THE IMAGE

This is a continuation of application Ser. No. 473,829, filed Feb. 2, 1990, now abandoned.

BACKGROUND OF THE INVENTION

1. Field of the Invention

The present invention is directed to an x-ray diagnostics installation, and in particular to such an installation which produces an image having a dominant region of primary medical interest.

2. Description of the Prior Art

It is known from German OS 31 27 648 to provide an x-ray diagnostics installation with a detector which measures the mean image brightness of a dominant region of the light image at the output screen of the x-ray image intensifier. The installation can produce video images as well as individual images and series of individual images. The detector serves the purpose of maintaining the mean image brightness constant in the dominant region. In German OS 31 27 648 this is accomplished by disposing a detector in the parallel beam path of the light between the output luminescent screen of the x-ray image intensifier and the video camera. The dominant region is selected from the total light image and is coupled out of the parallel beam path by a mirror. Selection of the dominant image can be undertaken with a dominant disk disposed in front of a photomultiplier or an element having a plurality of light-sensitive surfaces which are individually selectable. The adjustment of the shape, position and size of the dominant region using such a dominant disk, however, is limited by the size of the disk.

It is generally standard in such x-ray image intensifiers to switch the format of the x-ray image intensifier dependent on the size of the subject to be observed, and dependent on a desired magnification, so that identical surfaces on the input luminescent screen illuminate or correspond to a different surface on the output luminescent screen. A magnification of the image of the examination subject can thus be achieved in a simple manner.

A disadvantage is such known systems is that the dominant region changes due to changing the format of the x-ray image intensifier. This can be prevented by providing an appropriate opening in the dominant disk for each available adjustment of the x-ray image intensifier, with the opening in the dominant disk then being adjusted. This means that a plurality of openings corresponding to the imaging scale of the x-ray image intensifier must be provided for each desired shape and position of the dominant region, so that the dominant disk becomes enlarged to an undesirable extent and accordingly becomes cumbersome. If a detector having a plurality of light sensitive elements or surfaces were used, the electrical connections to the surfaces could be modified in accordance with the desired change in shape and position, however, the resolution with respect to the examination subject in the x-ray image undesirably changes due to the modification of the imaging scale of the x-ray image intensifier. Such a detector array would therefore have to be extremely finally sub-divided in order to be able to achieve an optimum matching of the detector surfaces to the examination subject, given a modification of the imaging scale of the x-ray image intensifier.

SUMMARY OF THE INVENTION

It is an object of the present invention to provide an x-ray diagnostics installation of the type described above wherein the options available for selection of the dominant region are increased.

It is a further object of the present invention to provide such an x-ray diagnostics installation which permits the measuring field to remain the same upon the occurrence of electron optical switching of the x-ray image intensifier.

The above object is achieved in an x-ray diagnostics installation constructed in accordance with the principles of the present invention wherein means are provided for modifying the optical imaging scale of the detector so that the position and/or size of the dominant region of the light image is adjustable with reference to the output image of the x-ray image intensifier. A plurality of different sizes can thus be set in a simple manner for each selected position and shape of the dominant region.

In a further embodiment of the invention, means are provided for varying the imaging scale, for example, by electron optical switching of the x-ray image intensifier which is coupled to the adjustment means for the detector, so that when the imaging scale of the x-ray image intensifier is changed the imaging scale for the detector is correspondingly changed. This means that the dominant region acquired by the detector remains the same with reference to the x-ray image. The position, shape and size of the dominant region thus remain the same with respect to the examination subject when switching the imaging scale.

In an further embodiment, the means for changing the imaging scale of the detector can consist of two optical elements preceding the detector in the direction of light propagation from the output screen of the x-ray image intensifier. The spacing between the two optical elements is changed when the imaging scale of the x-ray image intensifier is changed. Adjustment means for the detector is provided for maintaining the detector at all times in the focal point of the optical arrangement. A simple structure for the detector, which permits electronic switching, can be achieved in an embodiment wherein the detector consists of a matrix of light-sensitive surfaces or elements which can be respectively connected to a measuring amplifier individually or in groups. A portrayal of the orientation of the detector relative to the examination subject, as well as the calculation of the imaging scale for adjustment and service purposes can be achieved by providing openings in the detector having a defined position relative to the individual light sensitive surfaces of the detector, and by providing an illumination means disposed following the detector for mixing the openings into the x-ray image for monitoring the position of the dominant region.

The detector may be a multiplier which is preceded by an adjustable dominant disk for gating the desired portion of the x-ray image.

DESCRIPTION OF THE PREFERRED EMBODIMENTS

Figure 1:
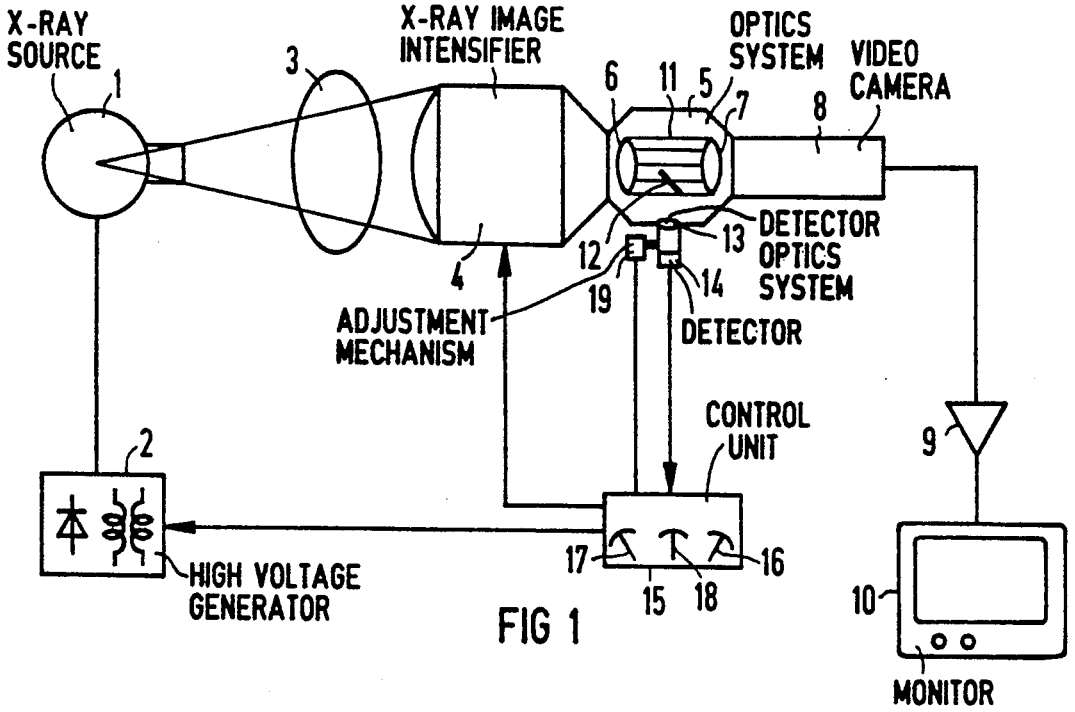
FIG. 1 is a block diagram of an x-ray diagnostics installation constructed in accordance with the principles of the present invention.

An x-ray diagnostics installation constructed in accordance with the principles of the present invention is shown in FIG. 1 which includes an x-ray source 1 which is operated by a high-voltage generator 2, and emits an x-ray beam which penetrates a patient 3. A radiation image, formed by radiation attenuated by the patient 3, is incident on the input luminescent screen of an x-ray image intensifier 4. The x-ray image intensifier 4 converts the radiation image into a visible (light) image on the output luminescent screen. An optical system 5, which includes a base objective lens 6 and a camera objective lens 7, is coupled to the output screen of the x-ray image intensifier 4. This permits the output image of the x-ray image intensifier 4 to be picked-up by a video camera 8. The output signal from the video camera 8 is amplified by a video amplifier 9 and is reproduced on a monitor 10.

A mirror 12 is provided in the parallel light beam path between the base objective lens 6 and the camera objective lens 7. The mirror 12 directs a portion of the parallel rays out of the beam path 11 to an optical system 13, which generates an image on a detector 14. The detector 14 is connected to a measuring or monitoring amplifier (not shown) which is included in a control unit 15. The control unit 15 includes a control element 16 for setting a rated value for the brightness of the portion of the image directed out of the parallel beam path 11 by the mirror 12, and is connected to the high voltage generator 2 for controlling the exposure.

The control unit 15 also includes a first adjustment element 17 by which the high voltages of the electrodes in the x-ray image intensifier 4 can be adjusted, so that the electron optics is switchable and different imaging scales can be set. A second adjustment element 18 is provided at the control unit 15 which is connected to an adjustment mechanism 19 which effects a variation of the imaging scale of the optical system 13 and the detector 14. The adjustment mechanism 19, for example, may consist of motor-driven cams, which mechanically act on the detector 14 and the optical system 13.

Figure 2:
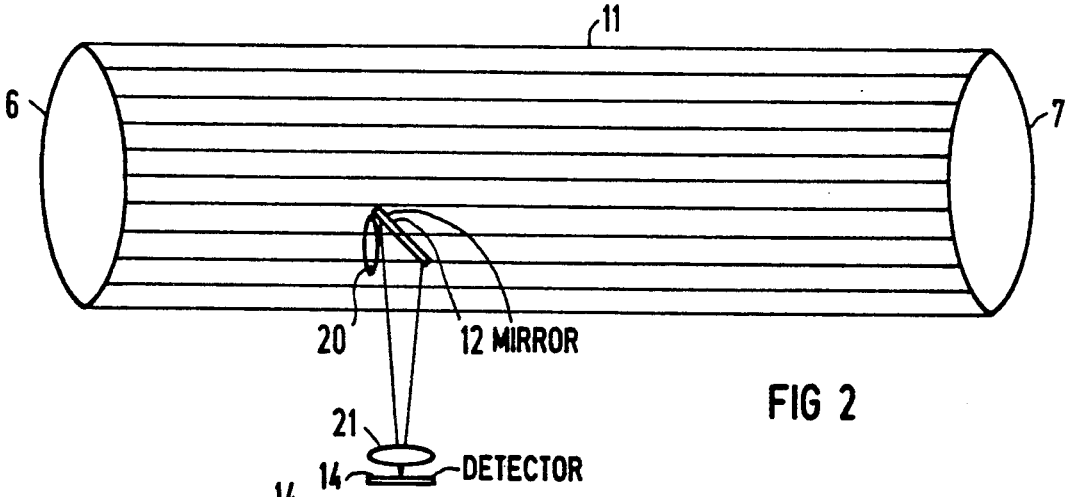
FIG. 2 is a schematic showing for explaining the operation of the detector constructed in accordance with the principles of the present invention.

An enlargement of the parallel beam path 11 between the base objective lens 6 and the camera objective lens 7 is shown in FIG. 2. The mirror 12, which may be formed by a prism, is disposed in the parallel beam path 11. A first lens 20 of the optical system 13 is disposed in front of the mirror surface. A second lens 21 of the optical system 13 is arranged in front of the detector 14 at a distance following the mirror 12, in the direction of light propagation. The detector 14 is situated in the focal point of the optical arrangement formed by the two lenses 20 and 21. This arrangement shown in FIG. 2 corresponds to the smallest optical imaging scale. The imaging of the x-ray image intensifier 4 is set by the first adjustment element 17 so that the overall entrance area of the x-ray image intensifier is completely imaged on the output luminescent screen of the x-ray image intensifier 4. The optical system 13 is thereby set so that the output image of the x-ray image intensifier 4 is imaged on the detector 14.

Figure 3:
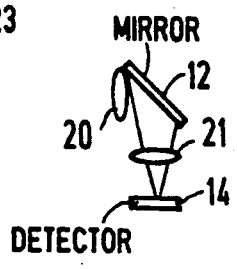
FIG. 3 is a schematic representation of a portion of the structure of FIG. 2 showing a further embodiment.

An arrangement having a larger optical imaging scale is shown in FIG. 3. In this embodiment, the second lens 21 and the detector 14 were adjusted to such an extent by the adjustment mechanism 19 that the output luminescent screen is now imaged only on a part of the detector 14. Since this is normally coupled with the adjustment of the imaging scale of the x-ray image intensifier 4, this means that a smaller part of the input luminescent screen of the x-ray image intensifier 4 is imaged on the overall output luminescent screen, so that the examination subjects on the output luminescent screen appear enlarged. As a result of the corresponding modification of the imaging scale of the lenses 20 and 21, which automatically ensues by coupling the first adjustment element 17 to the second adjustment element 18, a corresponding magnification is achieved, so that the dominant region once selected within the examination subject is preserved in the same size even after a modification of the electron optical imaging scale of the x-ray image intensifier 4.

Figure 4:
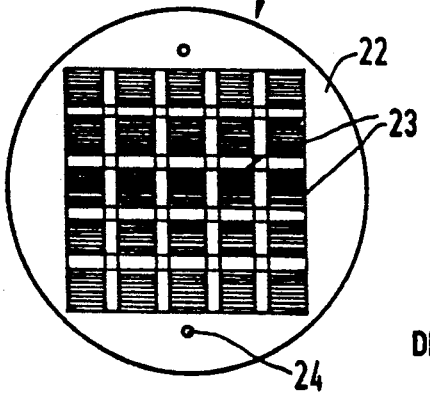
FIG. 4 is a plan view of the detector in the embodiment of FIG. 2.

A plan view of a detector 14 of the type suitable for use in the embodiment of FIG. 2 is shown in FIG. 4. The detector 14 has a plurality of separate light sensitive surfaces 23 arranged in a matrix on a disk 22. The light-sensitive surfaces 23 are connected to the control unit 15, and may be connected to the aforementioned measuring or monitoring amplifier individually or in groups for selecting the dominant region. Bores 24 can be provided in the disk 22 in defined positions relative to the light-sensitive surfaces 23. The bores 24 can be imaged onto the output luminescent screen of the x-ray image intensifier via the mirror 12 and the base objective lens 6 by providing an illumination source (not shown) disposed following the detector 14. The images of the bores 24 can thus be acquired by the camera 8 and can be reproduced on the monitor 10. An allocation of the position to the individual surfaces can thus be identified.

Figure 5:
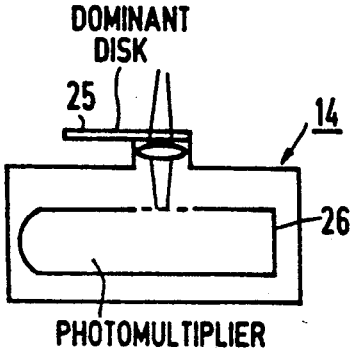
FIG. 5 is a schematic representation of a further embodiment of a detector for use in all embodiments of the installation.

A further embodiment of a detector 14 is schematically shown in FIG. 5, which consists of the known combination of a dominant disk 25, which precedes a detector 26, for example a photomultiplier. Different measuring regions can thus be selected by selecting openings of different sizes and different positions on the dominant disk 25. An opening in the dominant disk 25, once selected, is adapted to the imaging scale of the x-ray image intensifier 4 by means of the aforementioned modification of the imaging scale, so that a further adjustment of the dominant disk 25 is not required when adjusting the imaging scale of the x-ray image intensifier 4.

An x-ray diagnostics installation is thus obtained by means of which the imaging scale of the x-ray image intensifier 4 together with the imaging scale of the detector 14 are varied by varying the imaging scale with the first adjustment element 17, so that a dominant region, once selected by the second adjustment element 18, remains allocated to the same subject in the same size. By adjusting the second adjustment element 18, it is further possible vary the size and position of the dominant region, so that a plurality of adjustments are available for each set of prescribed dimensions of the light-sensitive surfaces 23 of the detector 14 or for each opening in the dominant disk 25.

Although modifications and changes may be suggested by those skilled in the art, it is intention of the inventor to embody within the patent warranted hereon all changes and modifications as reasonably and properly come within the scope of his contribution to the art.

I claim as my invention:

1. In an x-ray diagnostics installation for producing x-ray images having a source of x-rays, an x-ray image intensifier with an output screen on which a light image corresponding to x-rays attenuated by an examination subject is present, said light image having a dominant region, the improvement comprising:

detector means for measuring the mean image brightness of said dominant region, said detector means having an optical imaging scale; and means for varying said optical imaging scale of said detector means so that at least one of the position and size of said dominant region is adjustable relative to said light image.

2. The improvement of claim 1, further comprising means for adjusting the imaging scale of said x-ray image intensifier coupled to said means for varying the optical imaging scale of said detector means so that the imaging scale of the detector means is varied, given adjustment of the imaging scale of the x-ray image intensifier, so that the dominant region on said detector means remains the same with respect to said light image.

3. The improvement of claim 1, further comprising two lenses spaced from each other and disposed in front of said detector, and wherein said means for varying the optical imaging scale of said detector means is a means for varying the spacing between said lenses so that the detector means is always in the focal point of said lenses.

4. The improvement of claim 1, wherein said detector means comprises a matrix of separate light-sensitive surfaces, and means for optionally electrically connecting said light-sensitive surfaces to an amplifier individually or in groups.

5. The improvement of claim 4, wherein said detector means further has a plurality of openings in defined positions relative to said light-sensitive surfaces, and means for mixing images of said openings into said light image.

6. The improvement of claim 1, wherein said detector means comprises a multiplier having an adjustable dominant disk disposed in front thereof for gating a selected portion of said x-ray image.

* * * * *